United States Patent [19]

Tait et al.

[11] Patent Number: 4,689,636

[45] Date of Patent: Aug. 25, 1987

[54] DEACTIVATABLE RESONANT MARKER FOR USE IN RF ELECTRONIC ARTICLE SURVEILLANCE SYSTEM

[75] Inventors: William C. Tait, Oak Park Heights; Richard R. Lemberger, Forest Lake, both of Minn.

[73] Assignee: Minnesota Mining and Manufacturing Company, St. Paul, Minn.

[21] Appl. No.: 712,415

[22] Filed: Mar. 15, 1985

[51] Int. Cl.[4] ..... H01Q 1/36

[52] U.S. Cl. ..... 343/895

[58] Field of Search ..... 343/895; 340/572

[56] References Cited

U.S. PATENT DOCUMENTS

| | | | |
|---|---|---|---|
| 3,810,147 | 5/1974 | Lichtblau | 340/280 |
| 4,021,705 | 5/1977 | Lichtblau | 361/402 |
| 4,498,076 | 2/1985 | Lichtblau | 340/572 |

*Primary Examiner*—Robert E. Wise

*Attorney, Agent, or Firm*—Donald M. Sell; James A. Smith; William B. Barte

[57] ABSTRACT

A deactivatable marker for use in an RF electronic article surveillance system is disclosed, which marker includes a resonant circuit having at least one inductive component and one capacitive component. The circuit further comprises a component having two conductive layers separated only by an insulative thin-film which breaks down when at least a predetermined potential is applied across it to form a conductive path which changes the resonant frequency of the circuit. The two conductive layers are preferably configured to form a spiral multi-turn inductor and capacitor pads on opposing surfaces of a dielectric sheet, and to be embossed at a localized area, thereby contacting the layers except for the presence of the insulating thin-film.

11 Claims, 3 Drawing Figures

DEACTIVATABLE RESONANT MARKER FOR USE IN RF ELECTRONIC ARTICLE SURVEILLANCE SYSTEM

FIELD OF THE INVENTION

This invention relates to markers for use in electronic article surveillance systems wherein a radio frequency field creates resonant oscillations in a tuned inductive-capacitive circuit contained within the marker, the marker in particular being formed of a dielectric sheet having on opposite surfaces conductive layers configured to form an inductive component and to have opposing areas which in combination with the dielectric sheet sandwiched therebetween form the capacitive component.

BACKGROUND OF THE INVENTION

In article surveillance systems of the type referred to above, the markers have generally been single status, i.e., no means have been provided to enable deactivation, thus requiring outright destruction, such as by being cut in half, etc. in order to render the marker undetectable. It has been proposed to provide a marker having a fusible link as a part of the resonant circuit such that by melting the link, the circuit is physically and irreparably made incomplete or altered to prevent its detection. See, for example, Lichtblau, U.S. Pat. No. 3,810,147. In that patent, Lichtblau proposes a marker including at least two circuits resonant at different frequencies together with a fusible link. Energy may thus be absorbed at a high power level at one frequency to melt the link, making that circuit path incomplete, thus altering the resonant frequency of the other resonant circuit so that it cannot be detected. In a companion patent, U.S. Pat. No. 4,021,705, Lichtblau proposes additional fusible links which when melted, form circuits having still further resonant frequencies.

SUMMARY OF THE INVENTION

In contrast to such inductive-capacitive markers in which deactivation is provided severing a conductive path, i.e., by melting, to destroy or alter a resonant circuit, the deactivatable marker of the present invention comprises means for completing a conductive path where none was formerly present. The marker includes at least one inductive component, one capacitive component and a third component comprising at least a pair of conductive layers and an insulative thin film sandwiched therebetween, the components being coupled together to form a circuit resonant at at least one frequency. In a preferred embodiment, all components are formed of a dielectric layer having on opposite surfaces conductive layers, at least one of which layers is configured to form an inductive component and in which a capacitive component is formed by the opposing layers and the sandwiched dielectric layer. In such an embodiment, the marker further comprises at least one location at which the conductive layers are separated only by a thin-film of an insulative material which electrically breaks down to form a conductive path therethrough when at least a predetermined potential is developed across the thin-film. Deactivation of the marker is preferably effected by developing across the thin-film a potential sufficient to breakdown the thin-film. The resulting conductive path alters the resonant circuit to prevent its detection. Such a potential may conveniently be generated by inducing in the circuit resonant oscillations, the peak intensity of which exceeds the requisite breakdown potential.

Another aspect of the present invention pertains to a system in which the marker just described is used. In addition to the marker, such a system comprises a transmitter for producing an electromagnetic field within an interrogation zone, a receiver for detecting oscillations at at least one resonant frequency produced by the marker when excited by the field, and for producing an alarm siqnal in response thereto, and means for deactivating the marker to inhibit the detection thereof by the receiver. The deactivation means comprises means, such as a circuit, for applying at least a predetermined electrical potential across said thin-film to thereby breakdown the thin-film and create a conductive path between the conductive layers, which path alters the resonant frequency of the circuit and inhibits the detection by said receiver. Preferably, the deactivation circuit may be similar to that of the transmitter in that it may produce an electromagnetic field oscillating at a resonant frequency of the marker circuit, but which field is more intense and extends over a shorter distance. Such a field, would for example, be generated within a deactivation module and when the marker is positioned adjacent to, or inserted into the module, the field would induce into the marker circuit sufficient energy to give rise to an electrical potential across the thin-film in excess of the predetermined level.

DESCRIPTION OF THE PREFERRED EMBODIMENTS

Figure 1:
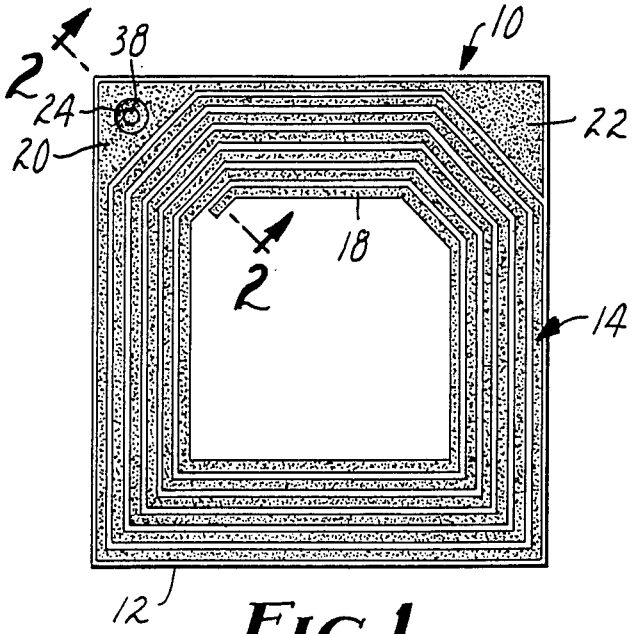
FIG. 1 is a plan view of a marker according to the present invention.

As shown in the plan view of FIG. 1, a preferred embodiment of the present invention is a marker 10 which comprises a dielectric 12 having on opposing surfaces metal layers appropriately configured to provide multi-turn inductive spirals. A top configured layer is shown in FIG. 1 as the layer 14. A similarly configured layer is provided on the opposite surface and cannot be seen in FIG. 1. Each of the conductive multi-turn spiral patterns forming an inductive component has areas such as the one at 18 which oppose like areas on the opposite conductive layer and which in combination with the dielectric sheet sandwiched therebetween form a distributed capacitive component. The inductive component and the capacitive component thus combine to form a tuned resonant circuit. As particularly evident in FIG. 1, the capacitive component can also include discrete areas such as the triangular areas 20 and 22 which oppose like triangular areas on the opposite conductive layer so as to form two capacitors. The legs of the inductive components are desirably precisely juxtaposed opposite similar legs of the inductive component in the opposing conductive layer to maximize the distributed capacitive component.

Of particular significance to the present invention is a means shown generally in the area 24 for controllably effecting a connection between the opposing metal layers. Such an area is shown more clearly in the expanded cross-sectional view shown in FIG. 2. As may there be seen, the dielectric sheet 12 has on opposing surfaces the top conductive layer 14 and a similar conductive layer 16 on the opposite surface. Each of the respective layers are configured to have a multi-turn spiral path formed therein, the respective legs of which are shown collectively as elements 26 and 28. Within the area 24, the top conductive layer 14 is deformed to form a dimple 38 within which the dielectric sheet 12 has been extruded, allowing the conductive sheet 14 to nearly contact the lower conductive layer 16. Actual contact of the two sheets 14 and 16 is prevented by the presence of an insulating thin-film 40. Such a film is desirably prepared as a submicron thick metal oxide layer. The area at the bottom of the dimple 38 thus comprises a third component comprising a pair of conductive layers, i.e. the layers 14 and 16, with the insulative thin-film 40 sandwiched therebetween. For example, if the conductive layer 16 is formed of an aluminum foil, the insulating thin-film 40 is conveniently prepared by anodizing the inner surface of the aluminum foil 16 prior to applying it to the surface of the dielectric sheet 12. Such an oxide film is preferably prepared by anodization in an electrolytic solution or by sputter or vapor deposition according to techniques well known to those skilled in the art. The dimple 38 is also produced by techniques well known to those skilled in the art, such as by a combination of heat and pressure, using two heated anvils, one having a round end and the other having a flat end.

The capacitive element formed by the opposing areas within the conductive layers 14 and 16 is designed to breakdown such that an electric discharge passes through the insulating film 40, when an RF field in excess of a predetermined intensity and frequency is applied in the general vicinity of the circuit but not in direct electrical contact therewith. This breakdown produces a conductive filament across the insulating film 40 which shorts out the capacitive element. This causes the circuit to stop resonating at its predetermined frequency. Such a breakdown is irreversible.

Consistent operation, i.e., breakdown of the insulating film only when at least a predetermined potential is developed across the film has particularly been found to result via the use of an anodized aluminum-oxide film. Such a film should be non-porous and free from pinholes, in order that it will support a field across it below the threshold point. The thickness of the oxide film has been found to be readily controlled during anodic deposition by applying a voltage across the electrodes used during anodization equal to the desired breakdown voltage. During such an operation, the current through the film is automatically reduced as the film is formed, and the resistance increases. Preferably, the thickness is selected to be approximately 0.15–0.3 $\mu$m. Since the oxide film typically forms to a thickness of approximately 0.0014 $\mu$m per volt, at which point the self-limiting behavior becomes manifest, such a thickness will result via a voltage applied to the anodization electrodes of approximately 100–200 volts. The film will subsequently also breakdown at the same voltage, thus this enables remote deactivation of the resultant marker upon exposure to a field which causes such a voltage to be developed across the thin-film.

A minimum practical anodized oxide thickness has been found to be about 0.03 $\mu$m, and is typically formed at anodization voltages of about 25 volts. Significantly thinner films are prone to include pinholes and the like, resulting in erratic behavior, inadvertent short circuits, and the like. Furthermore, the low breakdown voltage associated with such very thin films may be developed across the films if the markers are positioned immediately adjacent the transmitting antennas used in the associated surveillance systems, thus giving rise to the possible undesirable deactivation of the marker at the very moment when it is desirably detected.

In a further embodiment, it may also be desirable to ensure permanence of the shorted through connection, thereby avoiding undesired alarms, should a deactivated marker subsequently become reactivated. Repeated flexing of the desirably flexible marker of the present invention may, under some conditions, cause the conductive filament developed across the oxide thin-film to open, i.e., become non-conductive. To avoid such an occurrence, it has been found desirable to provide a reinforcement in the area of the dimple 38 to stiffen the marker in that area. Such a reinforcement may be by way of an additional layer, such as a polymer sheet, epoxy coating or the like, or may include an additional inorganic coating.

Figure 2:
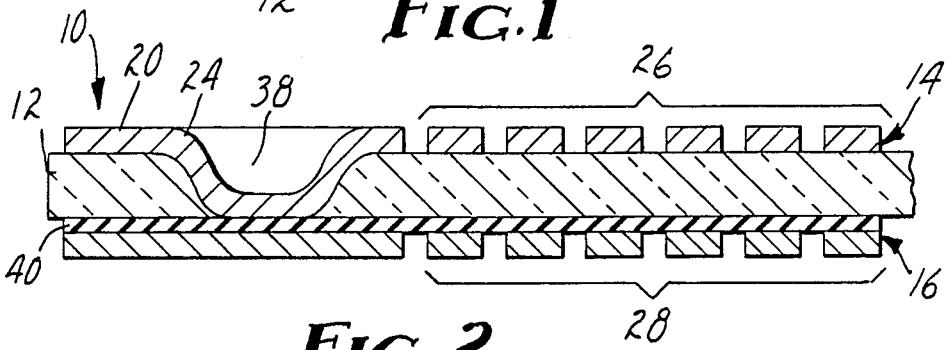
FIG. 2 is a cross-section of the embodiment shown in FIG. 1 taken along line 2—2 of FIG. 1.
Figure 3:
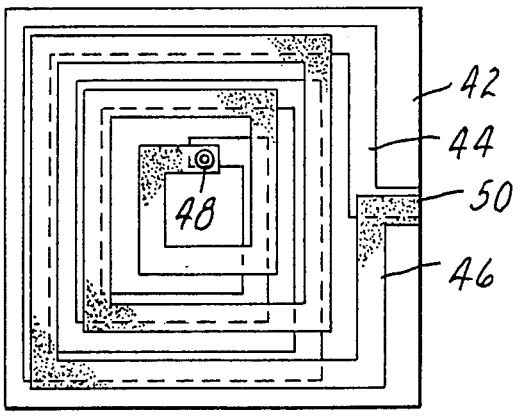
FIG. 3 is a plan view of another embodiment of a marker according to the present invention.

A further embodiment of a marker according to the present invention is set forth in FIG. 3. In such an embodiment, the marker comprises a dielectric sheet 42 having on opposing surfaces thereof a conductive layer 44 and 46. Both layers 44 and 46 are shown as being visible from the top of the marker as would be the case assuming the dielectric sheet 42 is transparent. Since transparency is not essential to the invention, a number of dielectric materials many of which are opaque or at least only translucent may be utilized. The respective conductive layers 44 and 46 are configured to provide two multi-turn spirals, forming inductive components. The respective legs of each of the two spirals are precisely positioned opposite each other with the dielectric sheet 42 sandwiched therebetween. As so constructed, the opposing conductive legs form a series of distributed capacitors to complete an inductive-capacitive resonant circuit. For purposes of clarity, in FIG. 3 the multi-turn spirals formed within the layers 44 and 46 are shown to be slightly offset with respect to each other. In practice, the opposing legs are as precisely positioned opposite each other as possible. Further, as shown in FIG. 3, the innermost leg of the opposing multi-turn spirals at an area 48 are brought close together via dimpling the top layer 44 so as to bring the layers substantially together but separated by a thin insulating film (not shown) in the same manner as shown within the area 38 of FIG. 2. In such an embodiment, the two conductive spirals formed of the conductive layers 44 and 46 may be desirably connected, such as by a portion 50 which extends around the edge of the dielectric sheet 42. Such a connecting link has been found to reduce the resonant frequency of such a distributed capacitance circuit by approximately a factor of two. When a short circuit is provided within the dimpled area 48 such that both the innermost and the outermost legs of the opposing spirals become shorted together, all resonant frequencies are eliminated. It will be appreciated that the dimpled area and insulating thin-film positioned to separate the proximate conductive layers may be located at any position within the inductive and capacitive circuits, so as to, for example, in FIG. 1 to short out a capacitive element or as in FIG. 3 to connect opposing legs of two inductive components. Modifications of a particular resonant frequency may thus be readily obtained by appropriately positioning the shortable portion at a desired location within an inductive multi-turn spiral or the like.

In the embodiments set forth in FIGS. 1–3, the inductive and capacitive components, as well as the third component of the marker have all been formed from metal foils laminated to opposing surfaces of a dielectric sheet. It is also within the scope of the present invention that the various components be formed of discrete components which are subsequently connected together to form a resonant circuit. Thus, the inductive component may be formed of a bobbin-wound coil, and may include a ferromagnetic core, if desired. Likewise, the capacitive component may be a discrete capacitor.

As discussed hereinabove, it is known in the prior art to provide fusible links which when melted open so as to alter the resonant frequency of an associated inductive-capacitive circuit. It has also been proposed that such circuits include at least two circuits resonant at different frequencies and that a fusible link be provided in the circuit resonant at a first frequency but which when opened causes the circuit resonant at a second frequency also to be modified. Accordingly, transmission of energy at the first frequency at a relatively high power level may be used to melt the fusible link without destroying or interfering with the detection of the circuit resonant at the second frequency.

In like manner, the marker of the present invention may be provided with a plurality of circuits resonant at different frequencies and a shortable portion provided in but one. As thus configured, such a marker may be deactivated by transmission of energy at the frequency at which the circuit including the shortable portion is resonant, such as, for example, at a higher power level. The other circuits may still be detected by transmission of energy at a much lower energy level.

The advantages obtained from the present invention by providing a shortable portion within an inductive-capacitive resonant circuit, as opposed to the fusible link techniques discussed above, are several fold. It will be first appreciated that a fusible link represents an area of higher resistance than that present in the adjoining conductive paths. The Q-factor of an inductive-capacitive circuit is directly dependent upon resistive losses in the circuit, and it is generally desirable to maintain the Q-factor as high as possible. The increased resistance of a fusible link thus deviates from that desired goal. In contrast, the shortable portion provided by a minute dimpled area and an insulating thin-film separating the two conductive layers has been found not to affect the Q-factor and similarly does not appreciably change the resonant frequency of the marker. Accordingly, no change in the method by which such a marker would be detected is required, enabling such markers to be used in the same systems previously employing markers not having the deactivatable feature.

Furthermore, it will be appreciated that significant transmitted energy is required in order to absorb sufficient energy to melt the fusible link as in the prior art technique. In contrast, it has been found that appreciably much less energy is required to breakdown a submicron thick insulating thin-film. For example, it has been found possible to deactivate the markers of the present invention, i.e., to short out the oxide thin-film upon exposure to localized RF fields at the resonant frequency of the marker circuit not appreciably more intense than the peak field normally employed during detection, but where the marker is only exposed to regions of lower field intensity. Fields of acceptable intensity have heretofore required markers containing fusible links as in the prior art to be placed immediately adjacent to the transmitting coil or antenna. In contrast, fields of the same intensity have been found suitable for deactivation of the markers of the present invention when positioned three to four inches away from the antenna. Such remote deactivation capabilities thereby appreciably enhance the usability of such a deactivatable marker.

Another aspect of the present invention pertains to a system (not shown) wherein the marker discussed above is desirably used. In addition to the marker itself, such a system includes a transmitter for producing an electromagnetic field within an interrogation zone, a receiver for detecting oscillations at at least one resonant frequency produced by the marker when excited by the field, and for producing an alarm signal in response to such detection, and means for deactivating the marker to inhibit/prevent its detection by the receiver. Such detection means typically comprises means for applying at least a predetermined electrical potential across the oxide thin-film to cause the film to electrically breakdown, creating the conductive path across the film which alters the resonant frequency.

Such a system is, therefore, not overly dependent upon the specific characteristics of the electromagnetic field produced within the interrogation zone or on the specific techniques used to detect the presence of the marker. For example, one such useful field characteristic which is known in prior art systems employs radio frequency fields which are swept through a range of frequencies, including a resonant frequency of the marker, with detection of the marker being based on absorption of energy by the marker at its resonant frequency. Other useful fields employ bursts of RF at the resonant frequency of the marker, with detection occurring in quiescent intervals between the bursts. Also, spaced apart pulses of electromagnetic energy may be employed to stimulate oscillations in the marker, which oscillations may be detected in the interval between the pulses. Detection based on harmonic oscillations is also known and can be employed in the present invention.

The means for deactivating the marker within the present system preferably produces an electromagnetic field at the resonant frequency of the marker circuit containing the shortable component portion. Such a field is transmitted at a power level such that when the marker is brought into proximity thereto sufficient energy is absorbed to short the shortable component. Thus, for example, when the marker is intended to be affixed to articles for sale in a retail sales establishment, a desensitizing bin or the like may be provided near a cashiers counter. When the articles having the markers affixed thereto are then positioned within the desensitizing bin, such a field may be energized and the shortable component within the marker shorted. Such an operation does not require the clerk or customer to be aware of where within the article the marker is located nor to precisely positioning the marker or article. It will be simlarly recognized that a large variety of other techniques and applications for such a deactivatable marker will be apparent to those skilled in the art.

We claim:

1. A deactivatable marker for use in an electronic article surveillance system having a transmitter for producing an electromagnetic field within an interrogation zone and a receiver for detecting the marker when excited by the field, said marker including at least one inductive component, one capacitive element and a third component comprising a pair of conductive layers, at least one of which is metallic, said layers being separated at at least one location by only an insulative thin-film formed on the surface of the metallic layer, said components being coupled together to form a circuit resonant at at least one frequency, whereby deactivation of the marker may be effected by developing across the thin-film at least a predetermined potential to thereby breakdown the thin-film and to form a conductive path between the conductive layers which alters the resonant frequency of the circuit to prevent detection thereof by said receiver.

2. A marker according to claim 1, wherein said thin-film comprises an oxide layer formed on the surface of the metal layer.

3. A marker according to claim 2, wherein said oxide layer is less than one micrometer thick.

4. A marker according to claim 1, wherein each of said conductive layers extends over an area and is juxtaposed from an area of the opposite layer, separated therefrom by a substantially uniformly thick dielectric layer to form one capacitive component.

5. A marker according to claim 4, wherein said thin-film extends over an area over which said conductive layers are nominally separated by said dielectric layer, but wherein said sheet is deformed to cause the conductive layers to be separated only by the insulating thin-film.

6. A marker according to claim 4, wherein said thin-film separates opposing areas of the conductive layers forming the capacitive component such that resonant oscillations built up in the circuit may cause a potential to be induced across the capacitive component which exceeds said predetermined potential.

7. A marker according to claim 6, wherein both of said conductive layers are separated by a substantially uniformly thick dielectric layer and are configured to provide substantially inductive multi-turn spiral paths, each turn of the spiral paths being juxtaposed from a like turn of the path in the other conductive layer, such that the opposing portions and dielectric layer sandwiched therebetween forms a distributed capacitive element.

8. A marker according to claim 1, wherein at least one of said conductive layers of said third component is configured to provide one inductive component.

9. An electronic article surveillance system comprising a transmitter for producing an electromagnetic field within an interrogation zone, a marker including at least one inductive component, one capacitive component and a third component comprising a pair of conductive layers, at least one of which is metallic, which layers are separated at at least one location by only an insulative thin-film formed on the surface of the metallic layer, said components being coupled together to form a circuit having at least one resonant frequency, a receiver for detecting oscillations at at least said one resonant frequency produced by the marker when excited by the field, and for producing an alarm signal in response thereto, and means for deactivating the marker to inhibit the detection thereof by the receiver, said means comprising means for applying at least a predetermined electrical potential across said thin-film to thereby breakdown the thin-film and create a conductive path between the conductive layers, which path alters the resonant frequency of the circuit and inhibts the detection by said receiver.

10. A system according to claim 9, wherein said means for applying said predetermined potential includes means for inducing oscillations in said marker circuit of sufficient intensity to develop across said thin-film at least said predetermined potential.

11. A system according to claim 10, wherein said marker includes said capacitive component and said third component in parallel such that resonant oscillations induced in the circuit by said applying means causes a potential across the capacitive and third components which exceeds the predetermined potential.

* * * * *